US006372970B1

(12) United States Patent
Saunders, Jr. et al.

(10) Patent No.: US 6,372,970 B1
(45) Date of Patent: Apr. 16, 2002

(54) STRINGED MUSICAL INSTRUMENT BODY AND NECK ASSEMBLY

(75) Inventors: Robert H. Saunders, Jr., Glastonbury; Nicholas Ladutko, Simsbury, both of CT (US); Donald M. Johnson, Sandisfield, MA (US); Frank I. Untermyer, Weatogue, CT (US); William P. Vassilopoulos, Westfield, MA (US); Clifford Gunsallus, North Canton; William Hudak, Hebron, both of CT (US)

(73) Assignee: Kaman Music Corporation, Bloomfield, CT (US)

( * ) Notice: Subject to any disclaimer, the term of this patent is extended or adjusted under 35 U.S.C. 154(b) by 0 days.

(21) Appl. No.: 09/575,320

(22) Filed: May 19, 2000

(51) Int. Cl.[7] ..... G10D 3/00
(52) U.S. Cl. ..... 84/293; 84/290; 84/291
(58) Field of Search ..... 84/293, 290, 291

(56) References Cited

U.S. PATENT DOCUMENTS

| | | | | |
|---|---|---|---|---|
| 3,424,048 | A | 1/1969 | Mack et al. | 84/290 |
| 3,474,697 | A | 10/1969 | Kaman | 84/267 |
| 3,699,836 | A | 10/1972 | Glasser | 84/291 |
| 3,880,040 | A | 4/1975 | Kaman | 84/291 |
| 4,056,034 | A | 11/1977 | Kaman | 84/267 |
| 4,090,427 | A | 5/1978 | Kaman | 84/291 |
| 4,119,009 | A | 10/1978 | Kaman, II | 84/293 |
| 4,145,948 | A | 3/1979 | Turner | 84/293 |
| 4,172,405 | A | 10/1979 | Kaman, II | 84/293 |
| 4,200,023 | A | 4/1980 | Kaman | 84/293 |
| 4,201,108 | A | 5/1980 | Bunker | 84/1.16 |
| 4,334,452 | A | 6/1982 | Morrison, III et al. | 84/1.16 |
| 4,408,516 | A | 10/1983 | John | 84/275 |
| 4,429,608 | A | 2/1984 | Kaman et al. | 84/291 |
| 4,539,886 | A | 9/1985 | Hoffart | 84/267 |
| 4,616,548 | A | 10/1986 | Anderson | 84/1.16 |
| 4,829,870 | A | 5/1989 | Ralston | 84/291 |
| 4,873,907 | A | 10/1989 | Decker, Jr. et al. | 84/291 |
| 4,890,529 | A | 1/1990 | Grant | 84/291 |
| 4,969,381 | A | 11/1990 | Decker, Jr. et al. | 84/291 |
| 4,989,491 | A | 2/1991 | Baggs | 84/723 |
| 5,170,000 | A | 12/1992 | Hayashida et al. | 84/192 |
| 5,171,616 | A | 12/1992 | Dejima | 428/22 |
| 5,171,926 | A | 12/1992 | Besnainou et al. | 84/275 |
| 5,189,235 | A | 2/1993 | Fishman et al. | 84/291 |
| 5,218,149 | A | 6/1993 | Tanaka et al. | 84/291 |
| 5,333,527 | A | 8/1994 | Janes et al. | 84/291 |
| 5,396,823 | A | 3/1995 | Hoshino | 84/291 |
| 5,406,874 | A | 4/1995 | Witchel | 84/291 |

(List continued on next page.)

*Primary Examiner*—Robert E. Nappi
*Assistant Examiner*—Kim Lockett
(74) *Attorney, Agent, or Firm*—McCormick, Paulding & Huber LLP

(57) ABSTRACT

An acoustical stringed instrument includes a body, which has a top member having a generally flat forward part. The body also has a back member which includes a side wall with an upper section and a lower section and an inner side wall surface generally perpendicular to the forward part of the top member. A neck member of the instrument has an elongated upper portion extending upwardly from the upper section of the body side wall. Additionally, the neck member has an elongated lower portion extending through the interior of the body between the upper section and the lower section of the side wall and spaced rearwardly of the forward part of the top member. The elongated lower neck portion has an upper mounting means fixed to the inner side wall surface at the upper section of the body side wall, and a lower mounting means fixed to the inner side wall surface at the lower section of the body side wall.

33 Claims, 6 Drawing Sheets

U.S. PATENT DOCUMENTS

| | | | | | |
|---|---|---|---|---|---|
| 5,461,958 | A | | 10/1995 | Dresdner et al. | 84/267 |
| 5,537,906 | A | | 7/1996 | Steinberger | 84/291 |
| 5,679,910 | A | * | 10/1997 | Steinberger | 84/291 |
| 5,682,003 | A | | 10/1997 | Jarowsky | 84/267 |
| 5,691,491 | A | | 11/1997 | DeGomez | 84/291 |
| 5,747,711 | A | | 5/1998 | Cavaness et al. | 84/291 |
| 5,811,703 | A | | 9/1998 | Hoshino | 84/267 |
| 5,895,872 | A | | 4/1999 | Chase | 84/291 |
| 5,898,872 | A | * | 4/1999 | Chase | 84/291 |
| 5,911,168 | A | | 6/1999 | Enserink | 84/291 |
| 5,945,614 | A | | 8/1999 | White | 84/267 |
| 5,955,688 | A | | 9/1999 | Cook | 84/291 |
| 6,034,309 | A | | 3/2000 | Teel et al. | 84/290 |
| 6,107,552 | A | | 8/2000 | Coomar et al. | 84/291 |

* cited by examiner

STRINGED MUSICAL INSTRUMENT BODY AND NECK ASSEMBLY

CROSS-REFERENCE TO RELATED APPLICATIONS

Some of the material disclosed herein is disclosed and claimed in the following U.S. patent application entitled "Stringed Musical Instrument Top Member", U.S. application Ser. No. 09/574356, which is hereby incorporated by reference and filed concurrently herewith.

FIELD OF THE INVENTION

The present invention relates generally to stringed musical instruments of the kind having a hollow body and a neck member, such as guitars. More specifically, the present invention relates to a body and neck assembly of the instrument in which the primary components, i.e., the back member, top member and neck member, cooperate together to provide a rigid instrument requiring minimal structural reinforcement.

BACKGROUND OF THE INVENTION

In a guitar, and other hollow body acoustical instruments, the musical tones produced by the strings are intensified and enriched by the supplementary vibration induced in the body and in the top member which forms a part thereof. Accordingly, it is desirable that the body be of relatively thin construction throughout its entire extent for effective sound production.

This thin construction is desirable whether the guitar is a classical guitar constructed primarily of fine grained soft woods, or a guitar constructed primarily of other materials, e.g., a composite material. The term "composite materials" means any component made chiefly of two or more weather resistant non-wood materials, such as carbon fibers embedded in an epoxy resin matrix with the fibers either being arranged randomly, unidirectionally or woven into a fabric . This is also the case where the guitar, or one of its primary components, is constructed of a combination of materials. By way of example, where the top of the guitar has a laminated construction which includes at least a pair of composite material layers with a core layer of wood or perhaps some other material, e.g., an aramid material, bonded therebetween. (Aramids are defined by the Merriam-Webster Collegiate Dictionary, and for purposes of this application, as any of a group of lightweight but very strong heat-resistant synthetic aromatic polyamide materials that are fashioned into fibers, filaments, or sheets and used especially in textiles and plastics.)

However, the guitar construction must have the necessary strength to support the forces exerted by the taunt strings on the general cantilevered arrangement of the neck and body. The strings transmit sound vibrations to the top through a bridge mounted to the front face of the top over which the strings are tightly strung. To compensate for the tension forces produced by the strings, prior art guitars generally require a significant amount of structural reinforcement, e.g., various configurations of braces on the inner surface of the top, and/or tension bars in the neck. These reinforcements add considerably to the manufactures cost and weight of the instrument and are known to affect the tone. Accordingly, in the construction of prior art instruments some compromise is therefore necessary, and structural integrity is often attained in such instruments at some sacrifice to the instrument's acoustical performance.

The connection between the neck and the body, i.e., the neck/body connection, is also important since any weakness in this area will allow bending of the body relative to the neck. Moreover, the neck/body connection must perfectly align and rigidly hold the neck in all three axial directions, i.e., upward/downward, forward/rearward and laterally. A quality guitar therefore requires an exceptionally strong and firm joint between the neck and the body providing excellent resistance to movement of the neck in any direction relative to the body by string forces, shock forces or any other forces imposed thereon.

However, a good neck/body connection is very difficult to consistently achieve in prior art guitars where the connection is made in primarily one place, i.e., at the upper end of the guitar. A single point connection is difficult and time consuming to align in all directions. Additionally the connection requires substantial structural reinforcement to remain rigid and stable under the moment forces applied by the taunt strings pulling on the peghead of the cantilevered neck.

In attempts to address this problem, prior art guitars generally utilize a relative massive neck block disposed upon the inner side wall surface at the upper section of the body side wall that is either bonded to the inner surface or is an integral portion of the side wall itself The lower or heel end of the neck is usually connected to the neck block through various mounting means, e.g., bonding pads, bolts, or tongue and groove. However, this adds considerably to the instruments cost and weight, is very difficult to consistently align properly and affects the acoustical performance of the instrument.

There is, therefore, a need for an improved body and neck assembly of an acoustical stringed instrument to provide a rigid instrument requiring minimal structural reinforcement.

SUMMARY OF THE INVENTION

The present invention offers advantages and improved alternatives over the prior art by providing an acoustical stringed instrument, e.g., a guitar, having a neck member which is mounted to the body 12 (FIG. 2) in two places to provide a neck/body connection which substantially and easily aligns and rigidly holds the neck member in all three axial directions. Additionally, the three primary components required in the assembly of the guitar, i.e., a top member, a back member and a neck member, provide mutual support for each other when assembled together to significantly reduce or eliminate additional structurally reinforcing elements which would otherwise be required.

These and other advantages are accomplished in an exemplary embodiment of the invention by providing an acoustical stringed instrument including a body, which has a top member having a generally flat forward part. The body also has a back member, which includes a side wall with an upper section and a lower section and an inner side wall surface generally perpendicular to the forward part of the top member. A neck member of the instrument has an elongated upper portion extending upwardly from the upper section of the body side wall. Additionally, the neck member has an elongated lower portion extending through the interior of the body between the upper section and the lower section of the side wall and spaced rearwardly of the forward part of the top member. The elongated lower neck portion has an upper mounting means fixed to the inner side wall surface at the upper section of the body side wall, and a lower mounting means fixed to the inner side wall surface at the lower section of the body side wall.

In another embodiment of the invention, the side wall of the back member has an outer surface generally perpendicular to the forward part of the top member, and the forward part of the top member has an outer edge and an inner surface. The top member also has a skirt projecting rearwardly from the inner surface of the forward part and extending along the edge of the forward part. The skirt has a laterally inward facing surface which is generally perpendicular to the forward part and which laterally overlies and is bonded to a portion of the outer surface of the body side wall.

Further features and advantages of the invention will be apparent from the following detailed description of the preferred embodiment of the invention, and from the accompanying drawings and claims.

DETAILED DESCRIPTION OF THE PREFERRED EMBODIMENTS

Figure 1:
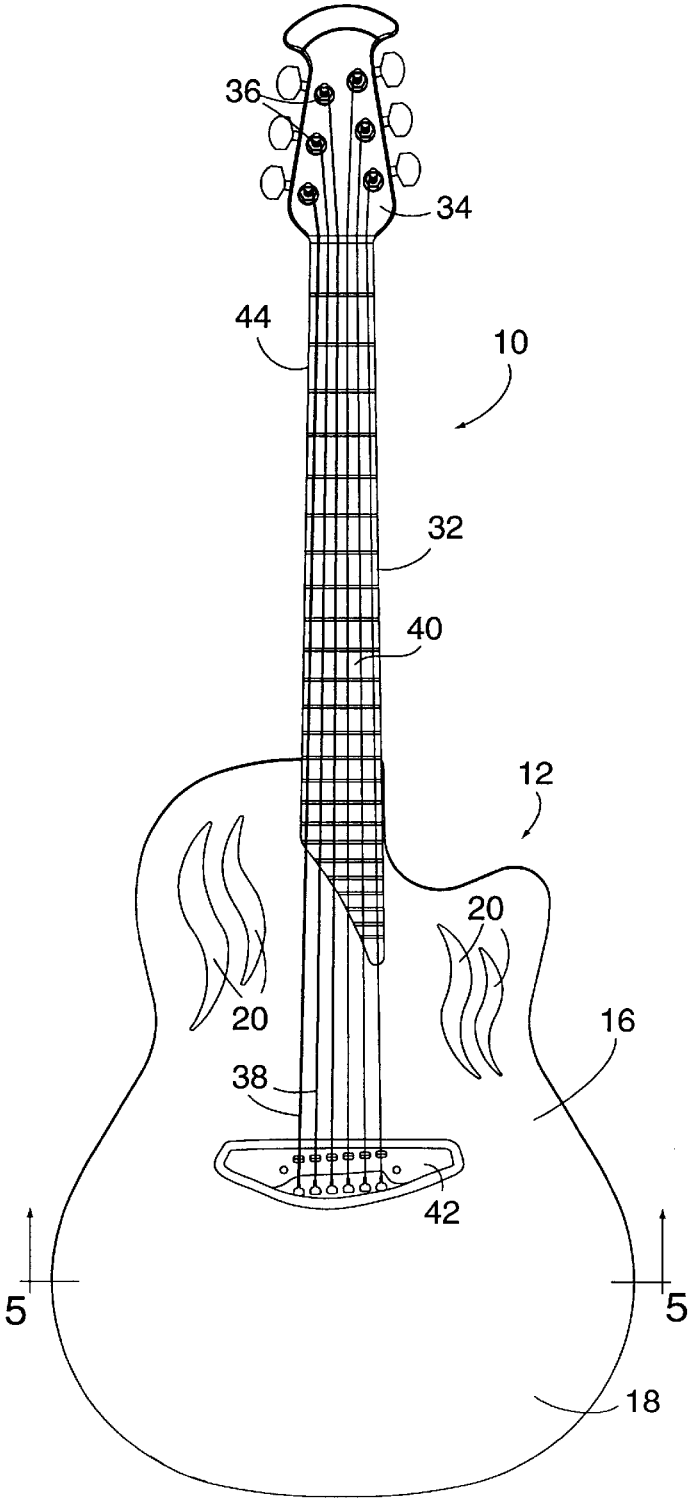
FIG. 1 is a plan view of a guitar constructed in accordance with the present invention.
Figure 2:
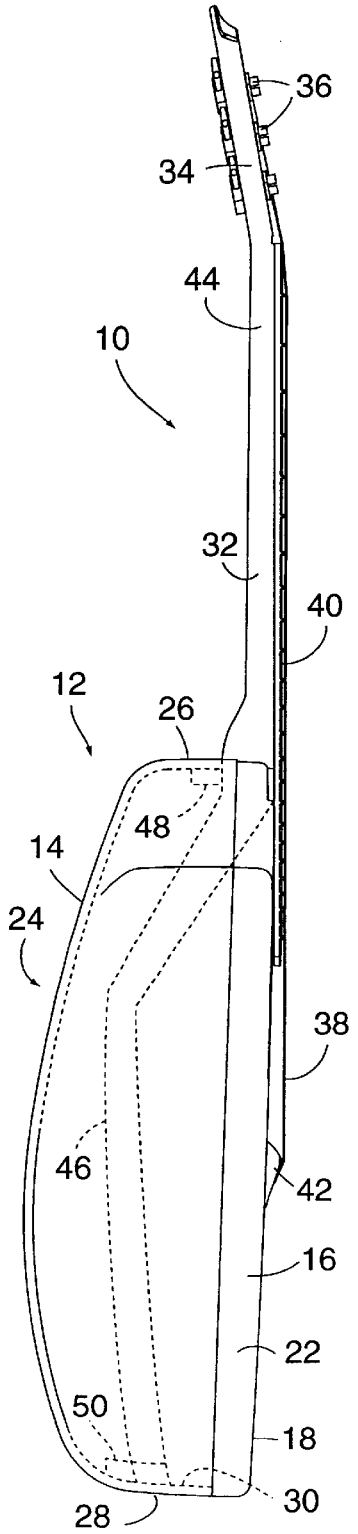
FIG. 2 is a side view of the guitar of FIG. 1.

Referring to FIGS. 1 and 2, a guitar 10 embodying the invention includes a hollow body 12 having a bowl-shaped back member 14 and a relatively thin top member 16. The top member has a generally flat forward part 18 with sound holes 20 extending therethrough. The top member 16 also has a skirt projecting rearwardly from, and generally perpendicular to, the forward part 18. The back member 14 has a side wall 24 which is generally perpendicular to the forward part 18 of the top member 16. The side wall 24 includes an upper section 26, a lower section 28 and an inner side wall surface 30.

Extending upwardly from the body 12 is a neck member 32 terminating at the top portion in peghead 34 provided with machine heads 36 for six strings 38, and carrying a fret board 40 disposed on its forward face. The strings 38 extend between the machine heads 36 and a bridge 42 secured to the forward part 18 of the top member 16. The neck member 32 has an elongated upper portion 44 extending upwardly from the upper section 26 of the body side wall 24. The neck member 32 also has an elongated lower portion 46 extending through the hollow interior of the body 12 between the upper section 26 and the lower section 28 of the side wall 24 and spaced rearwardly of the forward part 18 of the top member 16. The elongated lower neck portion 46 includes an upper mounting means 48 fixed to the inner side wall surface 30 at the upper section 26 of the body side wall 24, and a lower mounting means 50 fixed to the inner side wall surface 30 at the lower section 28 of the body side wall 24.

As used herein, and in the claims which follow, the relative terms "upper", "lower", "forward", "rear" and their derivatives are used with the instrument in question assumed to be oriented as shown in FIG. 1, i.e., with its peghead portion 34 uppermost, with its neck member 32 generally vertical, and with its top member 16 facing the viewer.

Figure 3:
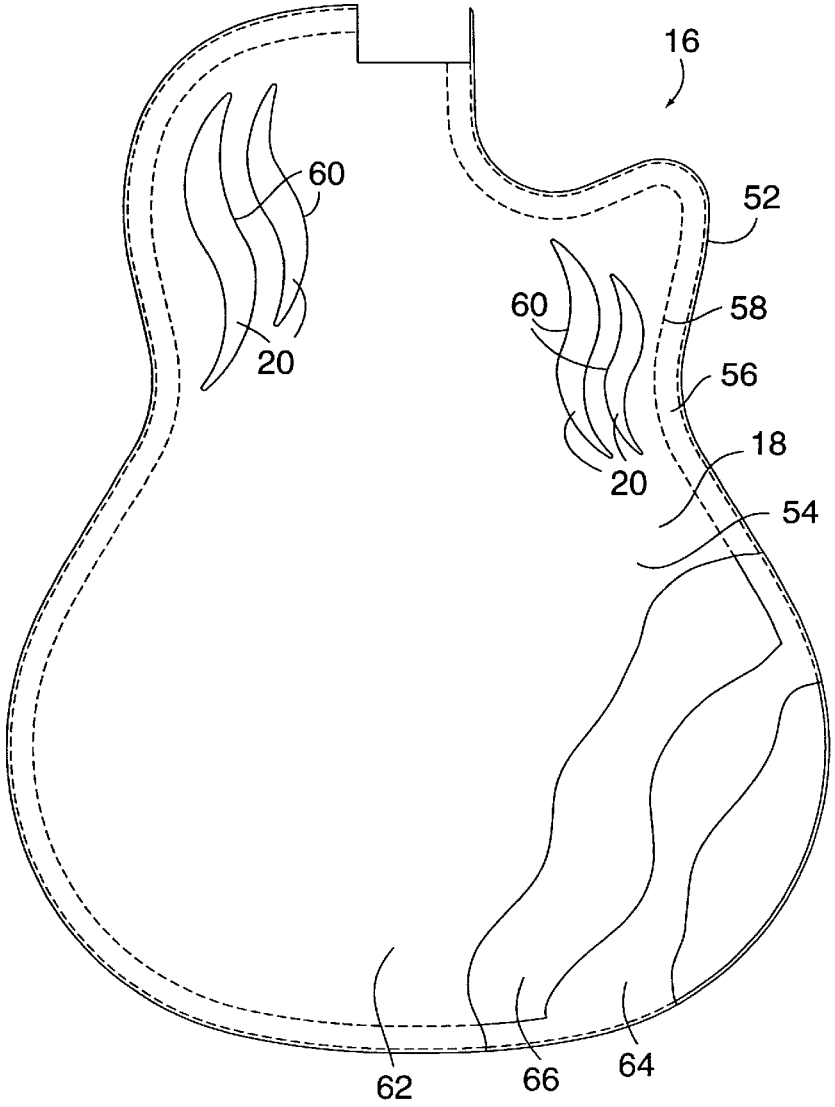
FIG. 3 is a plan view of the top member of FIG. 1 partially cut away.
Figure 4:
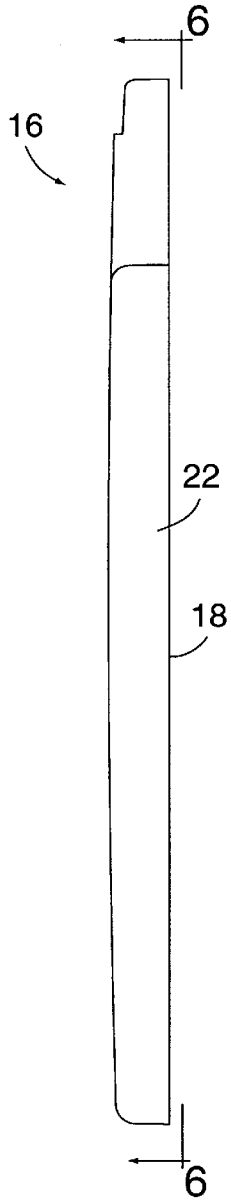
FIG. 4 is a side view of the top member of FIG. 3.

As shown in FIGS. 3 and 4, the skirt 22 extends along the outer edge 52 of the forward part 18 and projects rearwardly therefrom. The forward part 18 has an interior portion 54, i.e., sound board portion, and a flex edge portion 56 extending along the outer periphery 58 of the interior portion 54. The interior portion 54 also includes four sound holes 20 having boarders 60.

The interior portion 54 of the forward part 18 includes an outer composite material layer 62 and an inner composite layer 64 with a core layer 66 bonded between the inner and outer layers 62 and 64. The composite material layers 62 and 64 may each be made of various fiber reinforcing materials embedded in a suitable matrix of resin material, but preferably are each made of a woven fabric of carbon fibers embedded in an epoxy resin such as EPON 826. The core layer 66 is preferably a wood layer, but may also be composed of other suitable material, such as an aramid.

Figure 5:
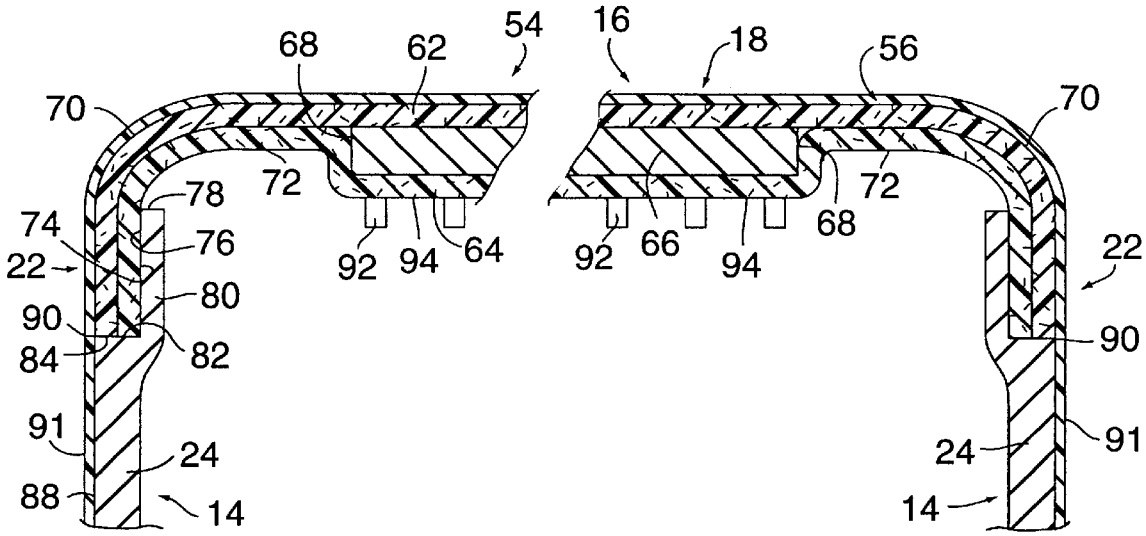
FIG. 5 is a cross sectional view of the top member and body side walls taken along the line 5—5 of FIG. 1.

Referring to FIG. 5, the composite material layers 62 and 64 extend outboardly from the outer periphery 68 of the interior portion 54 and are bonded in contact with each other to form the core free flex edge portion 56 of the forward part 18. A plurality of straight braces 92 (best seen in FIG. 6) project rearwardly from the inner surface 94 of the interior portion 54. The flex edge portion 56 has an outer edge 70 and an inner surface 72. The skirt 22 of the top member 16 is a further extension of the bonded composite layers 62 and 64, which is curved so as to project rearwardly from the inner surface 72, and which extends along the outer edge 70 of the flex edge portion 56. The skirt 22 has a laterally inward facing surface 74 which is generally perpendicular to the forward part 18 and which laterally overlies and is bonded to a portion on the outer surface 76 of the body side wall 24.

The body sidewall 24 includes a forward edge 78. Adjacent the forward edge 78 the body sidewall 24 is laterally inwardly stepped to provide an inwardly stepped wall portion 80 and a forwardly facing shoulder 82 located rearwardly of the forward edge 78. The skirt 22 includes a rear edge 84 which abuts against shoulder 82 and a laterally outwardly facing side surface 86 which is positioned substantially flush with the outer surface 88 of the sidewall 24, rearwardly the shoulder 82. The body 12, i.e., top member 16 and back member 14, is covered with a finish layer of resin 91 which hides the seam 90 formed by the rear edge 84 abutting against the shoulder 82 and enhances the overall visual appearance of the guitar 10. When assembled together to form the body 12, the top member 16 and the back member 14 mutually reinforce each other, reducing the amount of bracing required to compensate for the tension forces produced by the strings 38.

Figure 6:
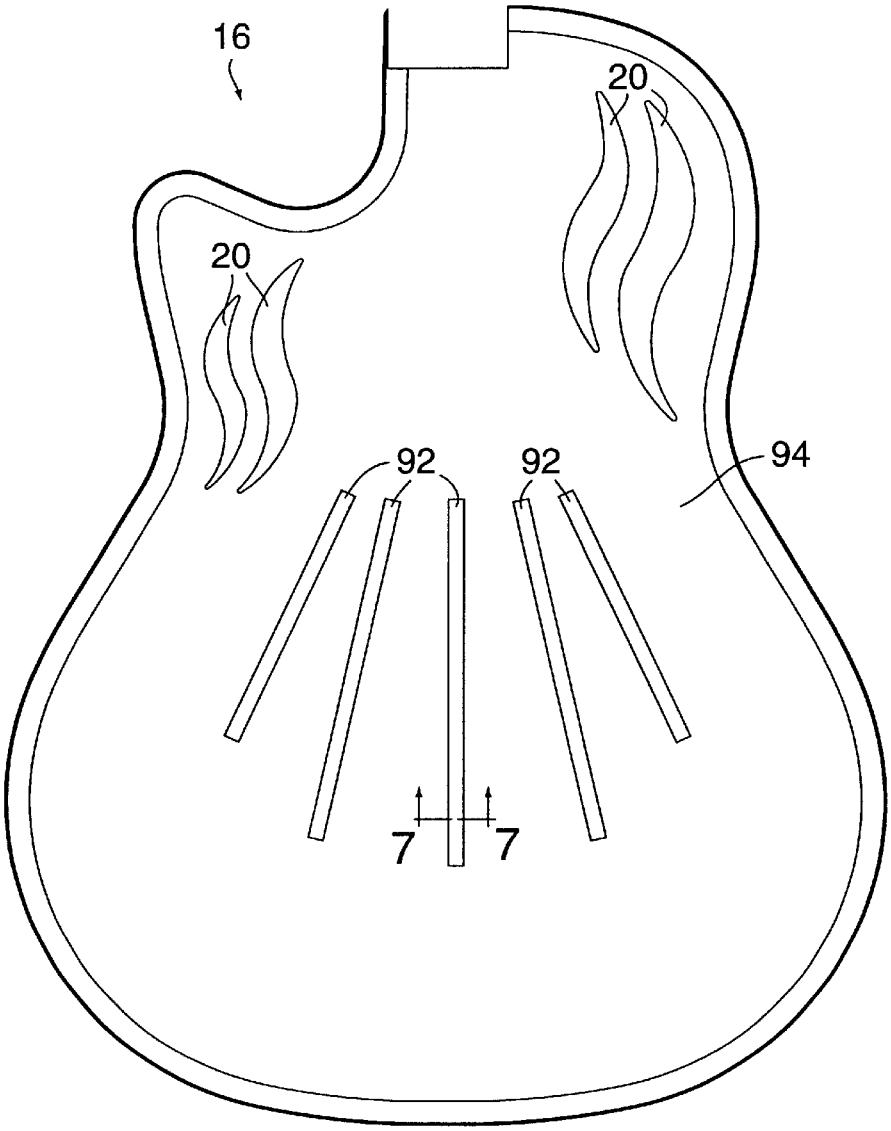
FIG. 6 is a bottom view of the top member taken along the line 6—6 of FIG. 5.

Referring to FIG. 6, the plurality of straight braces 92 project rearwardly from the inner surface 94 of the interior portion 54. Though the braces 92 are shown in a fan like pattern in this embodiment, other brace patterns, e.g., a vertical pattern, or combinations of patterns may be used and may also include cross braces. Additionally, other brace shapes, e.g. circular, may be used. The braces 92 are preferably made of graphite fiber fabric in a resin matrix and unidirectional graphite fibers in a resin matrix, and/or combination of graphite fabric and unidirectional graphite fibers in a resin matrix.

Figure 7:
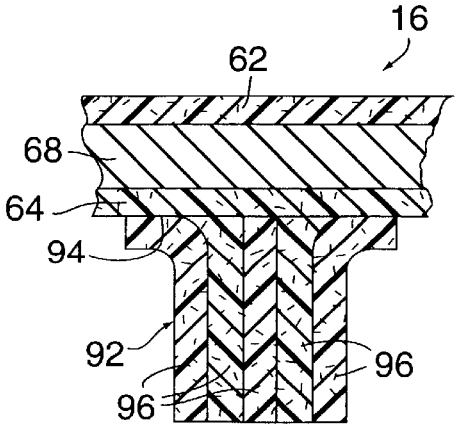
FIG. 7 is a cross sectional view of a typical brace taken along the line 7—7 of FIG. 6.

Referring to FIG. 7, the braces 92 each preferably include a plurality of composite layers or plies 96 laminated together and co-cured with the composite material of the top 16 to bond the braces 92 to the inner surface 94 of the interior portion 54. The number of plies 96 and the type of brace stack-up, fabric and/or unidirectional fibers, and shape is predetermined by the desired tonal qualities of the guitar 10.

Figure 8:
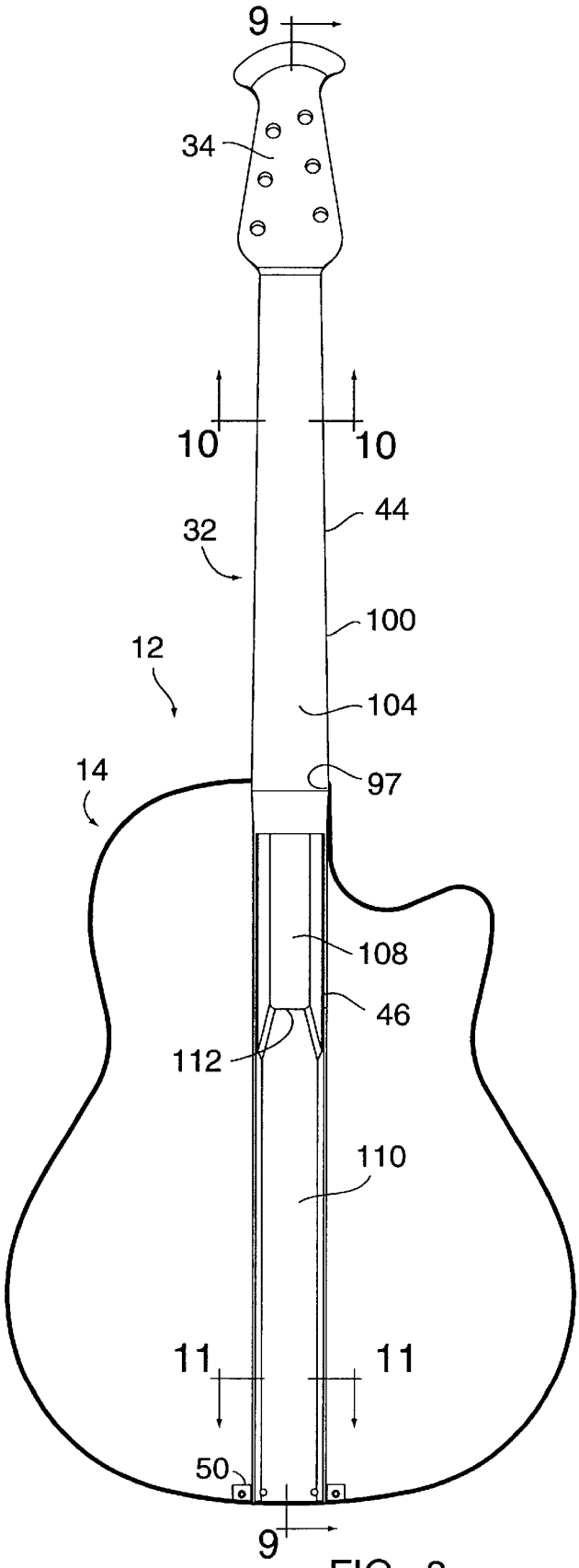
FIG. 8 is a plan view of the neck to body assembly of FIG. 1.
Figure 9:
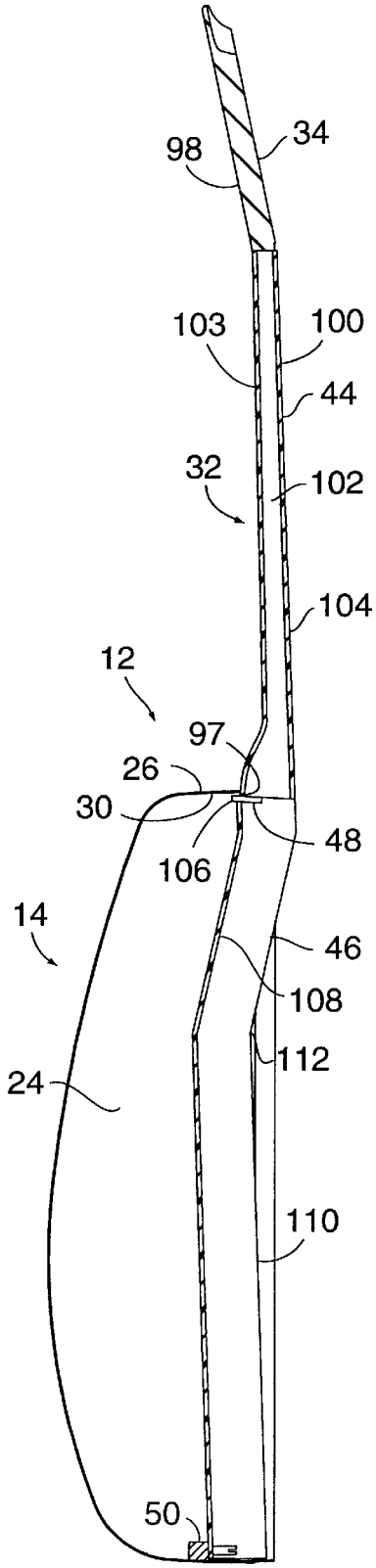
FIG. 9 is a cross sectional view of the neck to body assembly taken along the line 9—9 of FIG. 8.

Referring to FIGS. 8 and 9, the body 12 has a hollow interior within which the lower portion 46 of the neck member 32 is mounted. The bowl shaped back member 14 of the body 12 is preferably constructed of a composite material such as a woven fabric of carbon fibers embedded in an epoxy resin such as EPON 826. The back member 14 is substantially uniformly thin throughout its entire extent, and is relatively free of well-known structural reinforcements, e.g., braces and neck blocks. The back member 14 also includes a neck block free recess 97 in the upper section 26 of the body side wall 24 sized to receive the lower end of the upper portion 44 of the neck member 32.

The neck member 32 is preferably constructed of various types of composite materials best suited for the different portions of the neck member 32. By way of example a woven fabric of carbon fibers embedded in an epoxy resin for the thin walled lower portion 44, and fiberglass chopped fibers in an epoxy matrix incased in fabric plies for its solid peghead portion 34.

Figure 10:
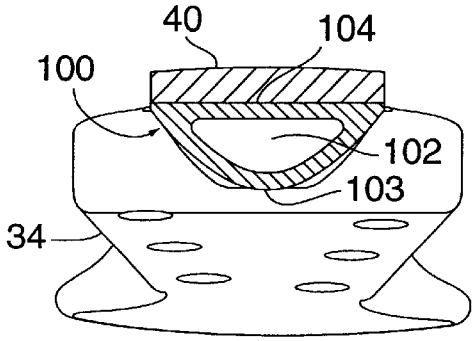
FIG. 10 is a cross sectional view of the upper portion of the neck member taken along the line 10—10 of FIG. 8.

The peghead portion 34 is located at the upper end of the upper portion 44, and has a solid cross section 98. The upper potion 44 also includes a neck portion 100 integrally connected to the peghead portion 34 and extending between the peghead portion 34 and the lower portion 46. As best seen in FIG. 10, the neck portion 100 has a hollow interior 102 with a rounded rear surface 103 and a flat forward surface 104 adopted to receive the fret board 40.

The upper mounting means 48 of neck member 32 (FIGS. 8 and 9) is located at the upper end of the lower portion 46 and has a laterally extending bonding pad 106 for bonding to the inner side wall surface 30 at the upper section 26 of the body side wall 24. The lower portion 46 also includes a first generally straight leg portion 108 extending downwardly from the upper mounting means 48, and a second generally straight leg portion 110 extending upwardly from the lower mounting means 50 at the lower end of the lower portion 46. The first and second leg portions, 108 and 110, are continuous with one another and form a bend 112 which spaces the lower portion 46 of the neck member 32 rearwardly from the forward part 18 of the top member 16.

Figure 11:
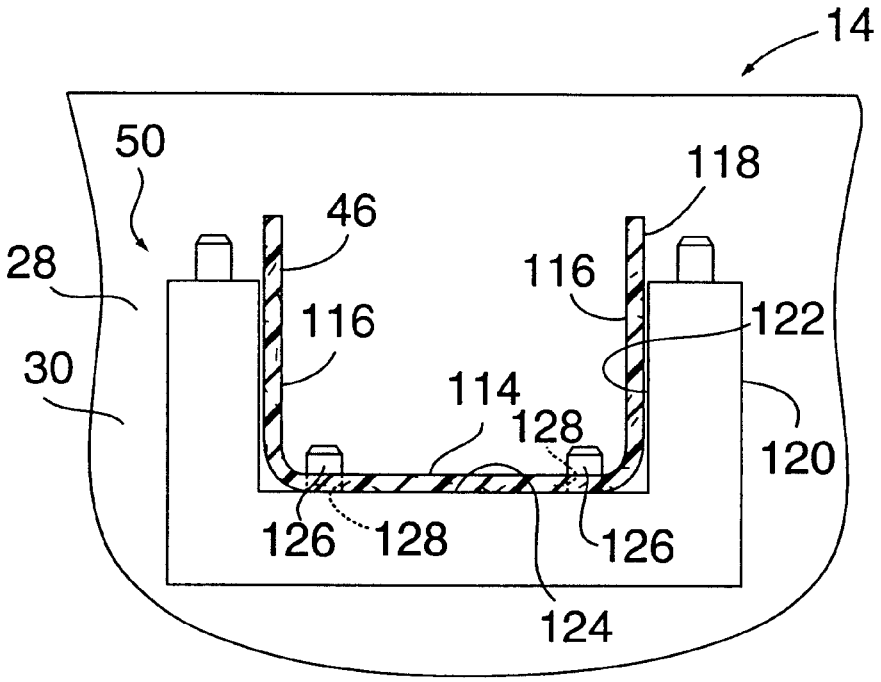
FIG. 11 is a cross sectional view of the neck to body assembly taken along the line 11—11 of FIG. 8.
Figure 12:
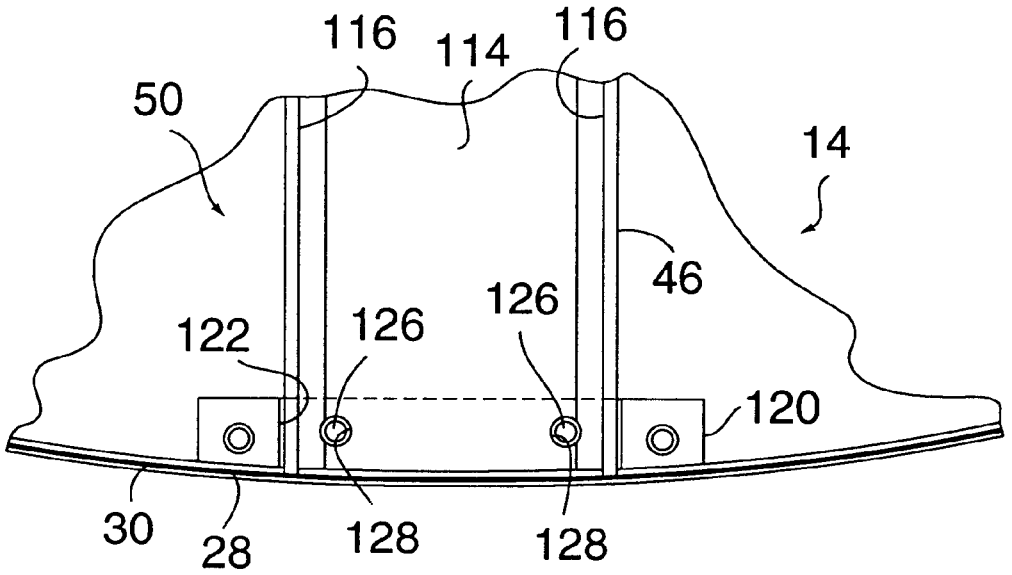
FIG. 12 is a top view of the lower mounting means of FIG. 11.

Referring to FIGS. 11 and 12, the lower portion 46 has an elongated rear wall 114 and pair of elongated side walls 116 which project forwardly from the lateral ends of the rear wall 114 to form a generally U-shaped cross section 118 throughout it's entire length. The back member 14 of the body has a mounting fixture 120 bonded to the inner side wall surface 30 at the lower section 28 of the body side wall, which includes a generally U-shaped recess 122. The recess 122 has a forwardly facing rear surface 124 from which a pair of locating pins 126 project forwardly. The lower mounting means 50 of the neck member 32 is a further extension of the lower portion 46 which is sized to be slidably received by the U-shaped recess 122 of the mounting fixture 120. The lower mounting means 50 also includes a pair of locating holes 128 projecting through the lower end of the rear wall 114, which are sized to slidably receive the locating pins 126.

Though the upper mounting means 48 (FIG. 9) has been described as the laterally extending bonding pad 106, and the lower mounting means 50 has been described as a further extension of the lower portion 46 sized to be received by the U-shaped recess 122, it will by clear to one skilled in the art that other upper and lower mounting means may be used and are considered within the scope of the present invention. By way of example, the lower mounting means may also be a bonding pad, or the upper mounting means may utilize screws or various other types of fastening hardware.

The two place upper and lower mounting means 48 and 50 of the neck member 32 to the body 12 provides a neck/body connection which substantially and easily aligns and rigidly holds the neck member 32 in all three axial directions, i.e., upward/downwardly, forward/rearwardly and laterally. Moreover, the three primary components of the guitar 10, i.e., the neck member 32, the back member 14 and the top member 16, rigidly support each other to eliminate or reduce structurally reinforcing elements that would otherwise have to be added. By way of example, neck block and torsion bars can be eliminated, and top member braces can be reduced.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An acoustical stringed instrument comprising:

a body having a hollow interior, a top member having a generally flat forward part, and a back member having a side wall with an upper section and a lower section and an inner side wall surface generally perpendicular to the forward part of the top member; and a neck member having an elongated upper portion extending upwardly from the upper section of the body side wall, and an elongated lower portion extending through the interior of the body between the upper section and the lower section of the side wall and spaced rearwardly of the forward part of the top member, the elongated lower neck portion having an upper mounting means fixed to the inner side wall surface at the upper section of the body side wall, and a lower mounting means fixed to the inner side wall surface at the lower section of the body side wall.

2. The acoustical stringed instrument of claim 1 wherein the top member, back member and neck member are each made substantially of a composite material.

3. The acoustical stringed instrument of claim 1 further wherein:

the side wall of the back member has an outer surface generally perpendicular to the forward part of the top member;

the forward part of the top member has an outer edge and an inner surface; and the top member also has a skirt projecting rearwardly from the inner surface of the forward part and extending along the edge of the forward part, the skirt having a laterally inward facing surface which is generally perpendicular to the forward part and which laterally overlies and is bonded to a portion of the outer surface of the body side wall.

4. The acoustical stringed instrument of claim 3 further wherein:

the side wall of the back member has a forward edge and adjacent the forward edge is inwardly stepped to provide an inwardly stepped wall portion and a forwardly facing shoulder located rearwardly of the forward edge-;and the skirt has a rear edge which abuts against the shoulder, and a laterally outwardly facing side surface which is positioned substantially flush with the outer surface of the side wall rearwardly of the shoulder.

5. The acoustical stringed instrument of claim 4 wherein the top member and back member are each made substantially of a composite material, and the top and back members are both covered with a finish layer of resin which hides a seam formed by the rear edge of the skirt abutting against the shoulder.

6. The acoustical stringed instrument of claim 3 wherein the forward part of the top member has at least a pair of composite material layers and a layer of core material bonded between the pair of composite material layers.

7. The acoustical stringed instrument of claim 6 wherein:

the forward part which has at least a pair of composite material layers and a layer of core material is an interior portion spaced inwardly from the side wall of the body, the forward part also has a core free flex edge potion bordering an outer periphery of the interior potion, the flex edge portion including at least one of the composite material layers of the interior portion; and the skirt includes at least one of the composite material layers of the interior portion.

8. The acoustical stringed instrument of claim 7 further wherein: the flex edge portion and the skirt each include the pair of composite material layers of the exterior portion and which pair of composite material layers are bonded together in the flex portion and in the skirt.

9. The acoustical stringed instrument of claim 1 wherein the upper portion of the neck member further comprises:

a peghead portion at the upper end of the upper portion, the peghead portion having a solid cross-section and being adopted to receive a plurality of machine heads for strings of the instrument; and a neck portion extending between the peghead portion and the lower portion, the neck portion having a hollow cross-section and a flat forward surface adapted to receive a fret board thereon.

10. The acoustical stringed instrument of claim 2 wherein the upper mounting means of the neck member further comprises a laterally extending bonding pad for bonding to the inner side wall surface.

11. The acoustical stringed instrument of claim 2 wherein the lower portion of the neck member has a generally U-shaped cross-section.

12. The acoustical stringed instrument of claim 11 wherein the lower portion of the neck member further comprises:

a first generally straight leg portion having a generally U-shaped cross-section extending downwardly from the upper mounting means; and a second generally straight leg portion having a generally U-shaped cross-section extending upwardly from the lower mounting means, the first and second leg being continuous with one another and forming a bend in the lower portion of the neck member.

13. The acoustical stringed instrument of claim 12 wherein:

the body has a mounting fixture bonded to the inner side wall surface at the lower section of the body side wall, the mounting fixture having a generally U-shaped recess; and the lower mounting means of the neck member has a generally U-shaped cross-section sidably received by the recess.

14. The acoustical stringed instrument of claim 13 wherein the mounting fixture recess has a forwardly facing rear surface from which a locating pin projects forwardly, and the lower mounting means of the lower portion of the neck member has a rear wall with a locating hole therethrough which receives the locating pin.

15. The acoustical stringed instrument of claim 1 wherein the body further comprises a neck block free interior.

16. The acoustical stringed instrument of claim 2 wherein the composite material further comprises graphite fibers in a resin matrix.

17. The acoustical stringed instrument of claim 16 wherein the resin matrix is an epoxy material.

18. An acoustical stringed instrument comprising:

a body having a hollow interior, the body including, a back member having a side wall with an upper section and an outer surface, and a top member including, a generally flat forward part having an outer edge and an inner surface generally perpendicular to the outer surface of the side wall, and a skirt projecting rearwardly from the inner surface of the forward part and extending along the edge of the forward part, the skirt having a laterally inward facing surface which is generally perpendicular to the forward part of the top member and is bonded to the outer surface of the body side wall; and a neck member including an elongated upper portion extending upwardly from the upper section of the body side wall.

19. The acoustical stringed instrument of claim 18 wherein the top member and back member of the body are each constructed substantially of a composite material made up of fibers in a resin matrix.

20. The acoustical stringed instrument of claim 19 further wherein:

the side wall of the back member has a forward edge and adjacent the forward edge is inwardly stepped to provide an inwardly stepped wall portion and a forwardly facing shoulder located rearwardly of the forward edge; and the skirt has a rear edge which abuts against the shoulder, and a laterally outwardly facing side surface which is positioned substantially flush with the outer surface of the side wall rearwardly of the shoulder.

21. The acoustical stringed instrument of claim 20 wherein the body is covered with a finishing layer of resin, which hides a seam formed by the rear edge of the skirt abutting against the shoulder.

22. The acoustical stringed instrument of claim 19 wherein the forward part of the top member has at least a pair of composite material layers with a layer of core material bonded between the pair of composite material layers.

23. The acoustical stringed instrument of claim 22 wherein:

the forward part which has at least a pair of composite material layers and layer of core material is an interior portion spaced inwardly from the side wall of the body; and the forward part also has a core free flex edge potion bordering an outer periphery of the interior potion, the flex edge portion including at least one of the composite material layers of the interior portion; and the skirt of the top member also includes at least one of the composite material layers of the interior portion.

24. The acoustical stringed instrument of claim 23 further wherein the flex edge portion and the skirt each includes the pair of composite material layers of the interior portion and which pair of composite material layers are bonded to one another.

25. The acoustical stringed instrument of claim 18 wherein the neck member is constructed of a composite material made of fibers in a resin matrix and further comprises:

a peghead portion disposed at the upper end of the upper portion, the peghead portion having a solid cross-section and adopted to receive a plurality of machine heads for strings of the instrument; and a neck portion extending between the peghead portion and the upper section of the body side wall, the neck portion having a hollow cross-section and a flat forward surface adapted to receive a fret board thereon.

26. A neck member for assembly with the body of an acoustical stringed instrument wherein the body has a hollow interior, a top member with a generally flat forward part, and a side wall with an upper section and lower section and an inner surface generally perpendicular to the forward part of the top member, the neck member comprising:

an elongated upper portion for extending upwardly from the upper section of the body side wall; and an elongated lower portion for extending through the interior of the body between the upper section and the lower section of the side wall and in rearwardly spaced relation to the forward part of the top member, the elongated lower portion including, an upper mounting means adapted to be fixed to the inner side wall surface at the upper section of the body side wall, and a lower mounting means adapted to be fixed to the inner side wall surface at the lower section of the body side wall.

27. The neck member of claim 26 wherein the neck member is constructed substantially of a composite material made up of fibers in a resin matrix.

28. The neck member of claim 27 wherein the upper portion further comprises:

a peghead portion disposed at the upper end of the upper portion, the peghead portion having a solid cross-section and adopted to receive a plurality of machine heads for the strings of the instrument; and a neck portion extending between the peghead portion and the lower portion, the neck portion having a hollow cross-section and a flat forward surface adapted to receive a fret board thereon.

29. The neck member of claim 27 wherein the upper mounting means further comprises a laterally extending bonding pad for bonding to the inner side wall surface.

30. The neck member of claim 27 wherein the lower portion has a generally U-shaped cross-section.

31. The neck member of claim 27 wherein the lower portion further comprises:

a first leg portion having a generally U-shaped cross-section extending downwardly from the upper mounting means; and a second leg portion having a generally U-shaped cross-section extending upwardly from the lower mounting means, the first and second leg portions being continuous with one another and forming a bend in the lower portion.

32. The neck member of claim 27 for use with a body having a mounting fixture bonded to the lower section of the inner side wall, and having a generally U-shaped recess, wherein the lower mounting means of the lower neck member portion is adapted to be slidably received by the recess.

33. The neck member of claim 32 for use with a body in which the recess has a forwardly facing rear surface from which a locating pin projects forwardly, wherein the lower mounting means has a rear wall portion with a locating hole adopted to slidably receive the locating pin when the lower mounting means is inserted into the recess.

* * * * *